US008764366B2

(12) United States Patent
Seo Mun

(10) Patent No.: US 8,764,366 B2
(45) Date of Patent: Jul. 1, 2014

(54) COMPRESSIVE ALBUM MANUFACTURING APPARATUS

(71) Applicant: Yang Seo Mun, Daejeon (KR)

(72) Inventor: Yang Seo Mun, Daejeon (KR)

( * ) Notice: Subject to any disclaimer, the term of this patent is extended or adjusted under 35 U.S.C. 154(b) by 82 days.

(21) Appl. No.: 13/670,894

(22) Filed: Nov. 7, 2012

(65) Prior Publication Data

US 2014/0099174 A1 Apr. 10, 2014

(30) Foreign Application Priority Data

Oct. 4, 2012 (KR) ..... 10-2012-0110002

(51) Int. Cl.
*B42C 1/12* (2006.01)
*B42C 19/08* (2006.01)
*B42C 13/00* (2006.01)

(52) U.S. Cl.
USPC ..... 412/8; 412/33; 412/900; 412/902; 270/58.12; 270/58.13

(58) Field of Classification Search
CPC ..... B42C 1/12; B42C 19/08; B42C 13/00
USPC ..... 412/8, 33, 900, 902; 270/58.12, 58.13
See application file for complete search history.

(56) References Cited

U.S. PATENT DOCUMENTS

| | | | | |
|---|---|---|---|---|
| 3,757,736 | A * | 9/1973 | Anderson | 412/37 |
| 3,863,596 | A * | 2/1975 | Anderson | 412/20 |
| 5,306,047 | A | 4/1994 | Otake et al. | |
| 7,326,019 | B2 * | 2/2008 | Loibl | 412/8 |
| 7,393,171 | B2 * | 7/2008 | Fu | 412/33 |
| 7,874,780 | B2 * | 1/2011 | Willauer | 412/8 |
| 2001/0038782 | A1 * | 11/2001 | Boss | 412/900 |
| 2008/0072774 | A1 * | 3/2008 | Parker et al. | 100/295 |
| 2009/0071866 | A1 * | 3/2009 | Chow | 412/37 |
| 2010/0290826 | A1 | 11/2010 | Kawaguchi et al. | |

FOREIGN PATENT DOCUMENTS

| | | | |
|---|---|---|---|
| JP | 2011-093142 | A | 5/2011 |
| JP | 2012-030421 | A | 2/2012 |
| KR | 10-0652516 | B1 | 12/2006 |
| KR | 10-1018500 | B1 | 3/2011 |

* cited by examiner

*Primary Examiner* — Kyle Grabowski
(74) *Attorney, Agent, or Firm* — Rabin & Berdo, P.C.

(57) ABSTRACT

Disclosed is a compressive album manufacturing apparatus in that independent areas for performing an aligning process, a heat providing process, a compressing process, and a cooling process respectively are formed in the multistage compressive album manufacturing apparatus, so that each process, which is done by hand, is merged into one, thereby rapidly manufacturing the bulk of compressive albums.

4 Claims, 3 Drawing Sheets

COMPRESSIVE ALBUM MANUFACTURING APPARATUS

BACKGROUND OF THE INVENTION

1. Field of the Invention

The present invention relates to a compressive album manufacturing apparatus. More particularly, the present invention relates to a compressive album manufacturing apparatus in that independent areas for performing an aligning process, a heat providing process, a compressing process, and a cooling process respectively are formed in the multistage compressive album manufacturing apparatus, so that each process, which is done by hand, is merged into one, thereby rapidly manufacturing the bulk of compressive albums.

2. Description of the Prior Art

Generally, an album is a booklet for storing pictures therein. There is an album for individually inserting the pictures therein. Also, the yearbook is manufactured by printing and binding the pictures in a lump. Moreover, in a wedding album or a first birthday album etc., the personal pictures are attached to surfaces of inner sheets in the form of a picture sheet, thereby manufacturing the album.

The manufacturing methods of the album are broadly divided into two, that is, a compressive type method and an adhesive type method.

In the compressive type manufacturing process of the album, the non-adhesive inner sheet and outer sheet are bound and then, the picture is attached to the surface of the inner sheet by using an adhesive and a pressure is applied thereto to complete the final product.

At this time, the adhesive is made of a liquid material having a viscosity. Also, the pressurization serves to prevent a wrinkle generated on the surface of the picture attached by the liquid adhesive. In some cases, the adhesive can be heated.

However, in the conventional manufacturing process of the compressive type, since the adhesives are applied to each picture or each inner sheet attached to the pictures, the work is cumbersome. Also, there is a problem in that it takes a comparable amount of time to manufacture the completed album.

SUMMARY OF THE INVENTION

Accordingly, the present invention has been made to solve the above-mentioned problems occurring in the prior art, and an object of the present invention is to provide a compressive album manufacturing apparatus in that independent areas for performing an aligning process, a heat providing process, a compressing process, and a cooling process respectively are formed in the multistage compressive album manufacturing apparatus, so that each process, which is done by hand, is merged into one, thereby rapidly manufacturing the bulk of compressive albums.

Another object of the present invention is to provide a compressive album manufacturing apparatus capable of significantly improving workability thereof and manufacturing in bulk in comparison with the conventional techniques in that pictures are attached to surfaces of inner sheets one by one by using an adhesive.

In order to accomplish this object, there is provided a compressive album manufacturing apparatus, including:

an aligning means having an air nozzle for providing an air formed at an upper portion thereof;

a heat supplying means formed at a lower portion of the aligning means and having a heat supplying part for supplying a heat therein;

a compressive cooling means formed at a lower portion of the heat supplying means and having a compressing part for performing a compression therein and a cooling part formed at an upper portion thereof;

a moving box arranged with pictures and heat plates;

an elevator means connected with any one side of the moving box and operated in accordance with an operation of a motor part; and a centralized control means for controlling an operation of the air nozzle, the heat supplying means, the compressing part, the cooling part, and the motor part.

Preferably, the moving box includes: a bottom part for aligning the pictures and the heat plates thereon having one side connected with a hinge and the other side provided with a hydraulic cylinder; and an upper plate part having one side connected with a hinge and the other side provided with another hydraulic cylinder.

Preferably, the elevator means is connected with at least one or more moving box in order to circulate the moving boxes in accordance with an operation of the motor part.

Preferably, the pictures and inner sheets, which are inserted into the moving box, are sorted in order and the heat plates are inserted therein at regular intervals.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, an exemplary embodiment of the present invention will be described in detail with reference to the accompanying drawings.

Figure 1:
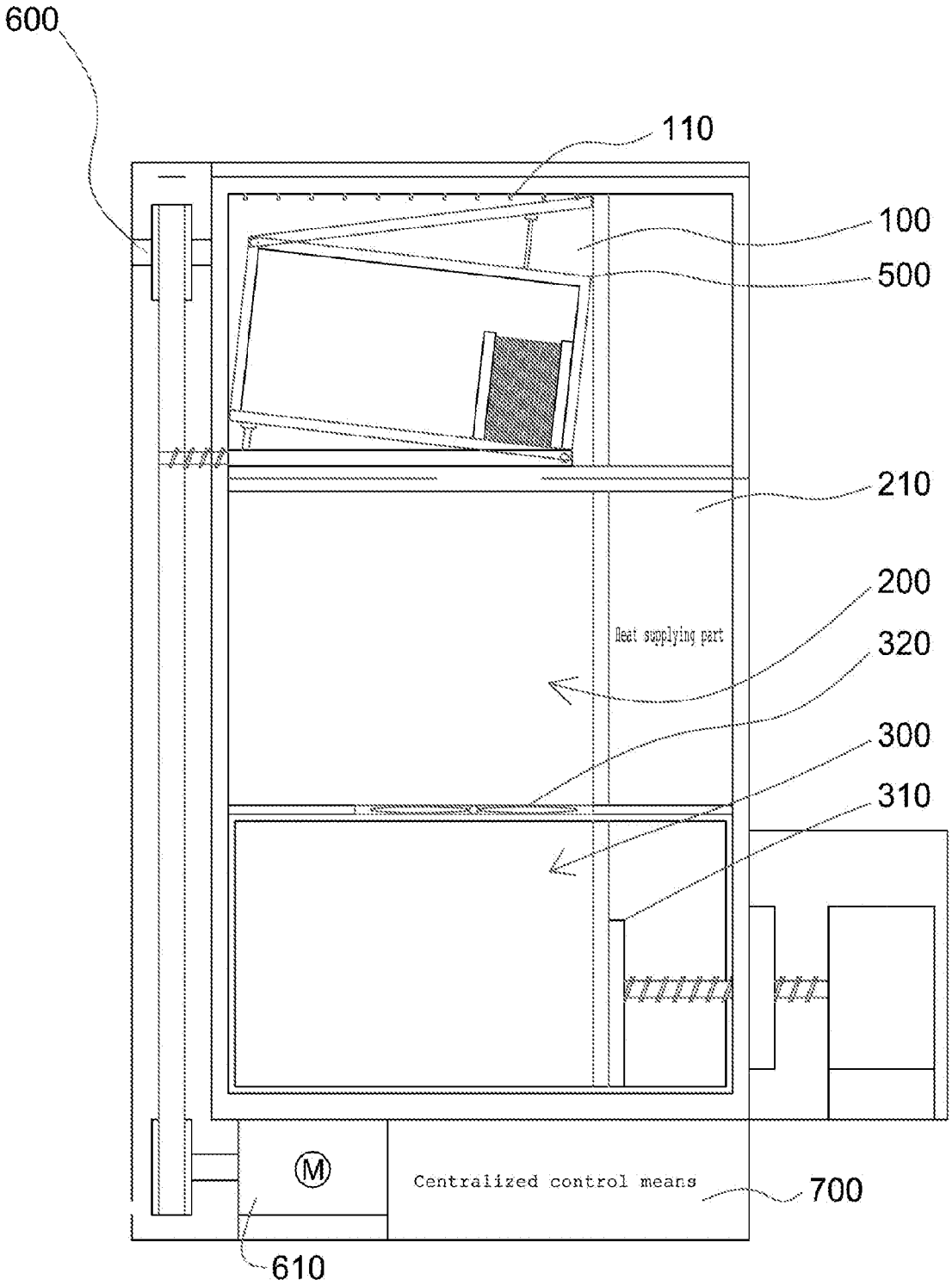
FIG. 1 is a front sectional view illustrating a compressive album manufacturing apparatus according to one embodiment of the present invention.

FIG. 1 is a front sectional view illustrating a compressive album manufacturing apparatus according to one embodiment of the present invention.

As illustrated in FIG. 1, the compressive album manufacturing apparatus includes:

an aligning means 100 having an air nozzle 110 for providing an air formed at an upper portion thereof;

a heat supplying means 200 formed at a lower portion of the aligning means 100 and having a heat supplying part 210 for supplying a heat therein;

a compressive cooling means 300 formed at a lower portion of the heat supplying means 200 and having a compressing part 310 for performing a compression therein and a cooling part 320 formed at an upper portion thereof;

a moving box 500 arranged with pictures and heat plates;

an elevator means 600 connected with any one side of the moving box 500 and operated in accordance with an operation of a motor part 610; and a centralized control means 700 for controlling an operation of the air nozzle, the heat supplying means, the compressing part, the cooling part, and the motor part.

When the moving box 500 is located in the aligning means 100, the operating signal is transmitted to the air nozzle 110 through the centralized control means 700, so that the pictures and the heat plates (electric heat plates) between the pictures are aligned through the air supplying.

The pictures and inner sheets, which are inserted into the moving box 500, are sorted in order and the electric heat plates are inserted therein at regular intervals.

For example, one set is a picture-inner sheet-picture-inner sheet-picture and another set is again aligned. At this time, the electric heat plate is inserted between one set and another set.

As described above, since the pictures and the inner sheets are fluid, they are constantly aligned to one side through the air.

If the aligning step is not performed, since the compressive album is not even in the final product, the chances of a defective product occurring increase.

Accordingly, after the aligning step, the heating compression is performed.

The heat supplying means 200 is formed at the lower portion of the aligning means 100 and the heat supplying part 210 for supplying the heat therein is formed therein.

After the aligning step, the operating signal is provided to the elevator means 600 by means of the centralized control means 700, so that the moving box 500 is moved to the heat supplying means 200 located on the lower portion of the moving box 500.

Thereafter, the operating signal is provided to the heat supplying part 210 by means of the centralized control means 700, so that the heating work is conducted.

Then, the operating signal is provided to the elevator means 600 by means of the centralized control means 700, so that the moving box 500 is moved to the compressive cooling means 300 located on the lower portion thereof.

After the moving thereof, the operating signal is provided to the compressing part 310 by means of the centralized control means 700, so that the pictures are compressed.

At this time, since the pictures stay hot owing to the heating process, it is necessary to go through the cooling process. Accordingly, when the compression is completed, the operating signal is provided to the cooling part 320 by means of the centralized control means 700, so that the cooling process is conducted, thereby finally manufacturing the compressive album.

Figure 2:
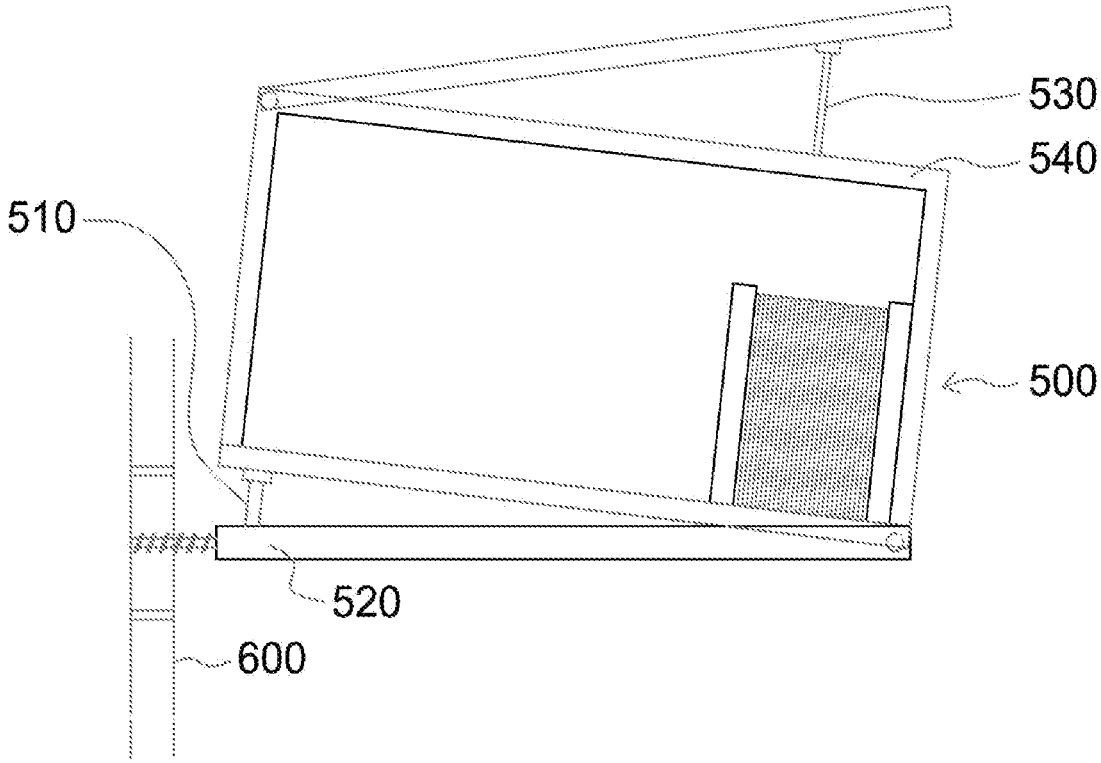
FIG. 2 is a sectional view illustrating a moving box of a compressive album manufacturing apparatus according to one embodiment of the present invention.

FIG. 2 is a sectional view illustrating a moving box of a compressive album manufacturing apparatus according to one embodiment of the present invention.

As illustrated in FIG. 2, the moving box of the compressive album manufacturing apparatus includes:

a bottom part 520 for aligning the pictures and the heat plates thereon having one side connected with a hinge and the other side provided with a hydraulic cylinder 510; and an upper plate part 540 having one side connected with another hinge and the other side provided with another hydraulic cylinder 530.

Considering a description of the operation thereof, firstly, the pictures are slantedly inserted into the moving box at an angle of 45. At this time, the operating signal is transmitted to the hydraulic cylinder 510 of the bottom part 520 by means of the centralized control means 700, so that a lower frame, in which the pictures are stored, is lifted above through a fluid pressure, thereby slanting the pictures.

Here, the operating signal is transmitted to the hydraulic cylinder 530 of the upper plate part 540 by means of the centralized control means 700, so that an upper frame is lifted above, thereby supplying the air therein.

Thereafter, when the aligning process is completed, the operating signal is transmitted to the hydraulic cylinder 510 of the bottom part 520 and the hydraulic cylinder 530 of the upper plate part 540 by means of the centralized control means 700, so that it horizontally places the moving box 500 and then, allows the moving box 500 to be moved to the heat supplying means 200.

In the meantime, the elevator means 600 can be formed on both sides thereof so as to bear a weight.

Figure 3:
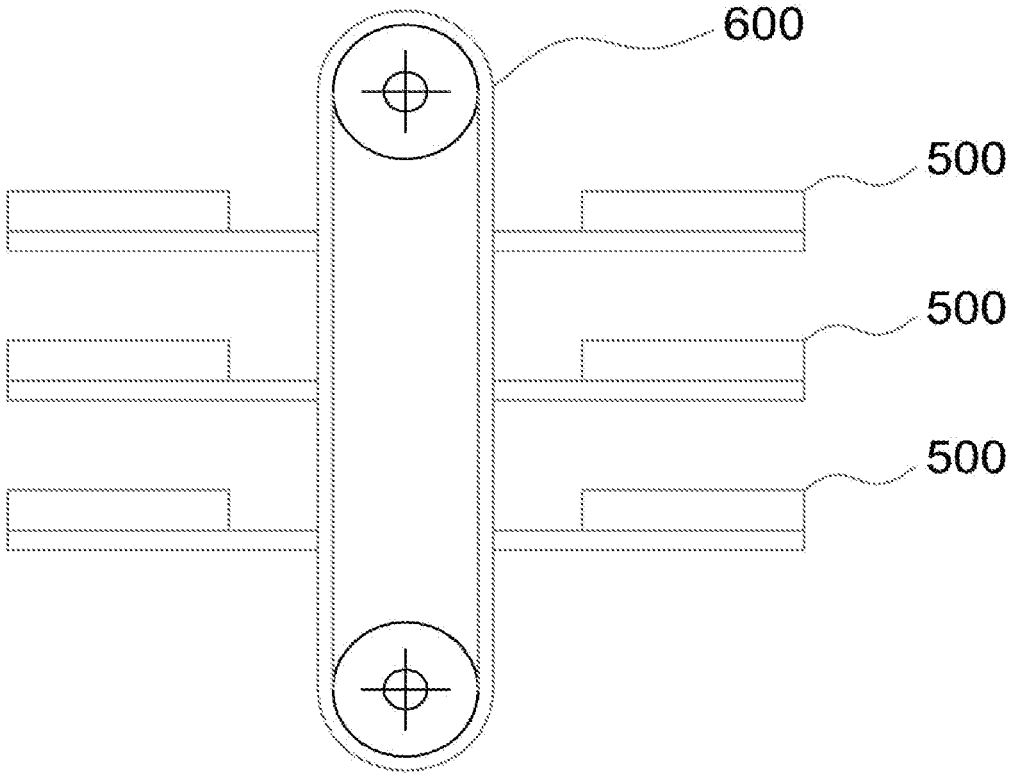
FIG. 3 is a schematic sectional view illustrating a plurality of moving boxes of a compressive album manufacturing apparatus according to another embodiment of the present invention.

FIG. 3 is a schematic sectional view illustrating a plurality of moving boxes of a compressive album manufacturing apparatus according to another embodiment of the present invention.

As illustrated in FIG. 3, the elevator means according to another embodiment of the present invention is connected with at least one or more moving box in order to circulate the boxes in accordance with an operation of the motor part 610.

That is, when the moving box 500 is moved to the heat supplying means 200 via the aligning means 100, another moving box 500 is located in the aligning means 100, so that it goes through the aligning process, meanwhile the moving box 500 located on the heat supplying means 200 goes through the heating process.

By such a configuration described above, it can rapidly manufacture the bulk of compressive albums.

Also, there are effects capable of significantly improving the workability thereof and manufacturing in bulk in comparison with the conventional techniques in that pictures are attached to surfaces of inner sheets one by one by using an adhesive.

Moreover, there is an effect in that the independent areas for performing an aligning process, a heat providing process, a compressing process, and a cooling process respectively are formed in the multistage compressive album manufacturing apparatus, so that the manual processes are merged into one, thereby rapidly manufacturing the bulk of compressive albums.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A compressive album manufacturing apparatus, comprising:

an aligning means having an air nozzle for providing an air formed at an upper portion thereof;

a heat supplying means formed at a lower portion of the aligning means and having a heat supplying part for supplying a heat therein;

a compressive cooling means formed at a lower portion of the heat supplying means and having a compressing part for performing a compression therein and a cooling part formed at an upper portion thereof;

a moving box arranged with pictures and heat plates;

an elevator means connected with any one side of the moving box and operated in accordance with an operation of a motor part; and a centralized control means for controlling an operation of the air nozzle, the heat supplying means, the compressing part, the cooling part, and the motor part.

2. The compressive album manufacturing apparatus as claimed in claim 1, wherein the moving box comprises:

a bottom part for aligning the pictures and the heat plates thereon having one side connected with a hinge and the other side provided with a hydraulic cylinder; and an upper plate part having one side connected with another hinge and the other side provided with another hydraulic cylinder.

3. The compressive album manufacturing apparatus as claimed in claim 1, wherein the elevator means is connected with at least one or more moving box in order to circulate the moving boxes in accordance with an operation of the motor part.

4. The compressive album manufacturing apparatus as claimed in claim 1, wherein the pictures and inner sheets, which are inserted into the moving box, are sorted in order and the heat plates are inserted therein at regular intervals.

* * * * *